US009685701B2

(12) United States Patent
Montgomery

(10) Patent No.: US 9,685,701 B2
(45) Date of Patent: Jun. 20, 2017

(54) HIGH ISOLATION ANTENNA SYSTEM

(71) Applicant: Achilles Technology Management Co II, Inc, Palo Alto, CA (US)

(72) Inventor: Mark T. Montgomery, Melbourne Beach, FL (US)

(73) Assignee: Achilles Technology Management Co II, Inc., Palo Alto, CA (US)

( * ) Notice: Subject to any disclaimer, the term of this patent is extended or adjusted under 35 U.S.C. 154(b) by 0 days.

(21) Appl. No.: 14/558,269

(22) Filed: Dec. 2, 2014

(65) Prior Publication Data

US 2015/0084824 A1 Mar. 26, 2015

Related U.S. Application Data

(63) Continuation of application No. 12/873,823, filed on Sep. 1, 2010, now Pat. No. 8,937,578.
(Continued)

(51) Int. Cl.
*H01Q 1/24* (2006.01)
*H01Q 1/52* (2006.01)
(Continued)

(52) U.S. Cl.
CPC ..... *H01Q 1/523* (2013.01); *H01Q 1/243* (2013.01); *H01Q 1/521* (2013.01); *H01Q 5/328* (2015.01);
(Continued)

(58) Field of Classification Search
CPC ..... H01Q 1/521; H01Q 1/243; H01Q 9/16; H01Q 9/42
(Continued)

(56) References Cited

U.S. PATENT DOCUMENTS 4,641,366 A * 2/1987 Yokoyama ..... H01Q 1/243 343/702
5,899,549 A 5/1999 Nakanishi et al.
(Continued)

FOREIGN PATENT DOCUMENTS

WO 2007/057417 5/2007

OTHER PUBLICATIONS

"International Search Report and Written Opinion for PCT/US2010/047529 dated Apr. 25, 2011".

*Primary Examiner* — Dieu H Duong
(74) *Attorney, Agent, or Firm* — Spruce Law Group, LLC

(57) ABSTRACT

An antenna system supports a common resonance mode and differential resonance mode, each with approximately equal radiation resistance and bandwidth at a given operating frequency band. The antenna system includes a resonant antenna section, a counterpoise, and two antenna ports. The resonant antenna section includes two spaced-apart poles and a distributed network therebetween. Each of the poles has a proximal end connected to the distributed network and an opposite distal end. The distal ends of the poles are separated from each other by a distance of ⅓ to ⅔ of the electrical wavelength at the given operating frequency. Each of the two antenna ports is defined by a pair of feed terminals with one feed terminal located on the counterpoise and the other feed terminal located on a different one of the poles of the resonant antenna section. The resonant antenna section, counterpoise, and ports are configured such that a signal within the given operating frequency band applied to one port is isolated from the other port.

17 Claims, 7 Drawing Sheets

Related U.S. Application Data

(60) Provisional application No. 61/238,931, filed on Sep. 1, 2009.

(51) Int. Cl.

| | |
|---|---|
| ***H01Q 9/16*** | (2006.01) |
| ***H01Q 9/42*** | (2006.01) |
| ***H01Q 5/35*** | (2015.01) |
| ***H01Q 5/40*** | (2015.01) |
| ***H01Q 5/328*** | (2015.01) |

(52) U.S. Cl.
CPC ..... *H01Q 5/35* (2015.01); *H01Q 5/40* (2015.01); *H01Q 9/16* (2013.01); *H01Q 9/42* (2013.01)

(58) Field of Classification Search
USPC ..... 343/700 MS, 702
See application file for complete search history.

(56) References Cited

U.S. PATENT DOCUMENTS

| | | | | |
|---|---|---|---|---|
| 6,130,650 | A | 10/2000 | Curtis et al. | |
| 6,339,400 | B1 | 1/2002 | Flint et al. | |
| 7,289,068 | B2 * | 10/2007 | Fujio et al. | 343/700 MS |
| 7,388,545 | B2 | 6/2008 | Wu et al. | |
| 7,411,555 | B2 | 8/2008 | McInnis | |
| 7,872,608 | B2 | 1/2011 | Li | |
| 2002/0024469 | A1 | 2/2002 | Masaki | |
| 2002/0171588 | A1 | 11/2002 | Fang | |
| 2007/0001911 | A1 | 1/2007 | Fujio | |
| 2007/0040754 | A1 | 2/2007 | Liu | |
| 2007/0229366 | A1 | 10/2007 | Kim | |
| 2008/0074341 | A1 | 3/2008 | Chung | |
| 2008/0252536 | A1 | 10/2008 | Anguera et al. | |
| 2008/0252538 | A1 | 10/2008 | Ying | |
| 2009/0153411 | A1 | 6/2009 | Chiang et al. | |
| 2009/0322639 | A1 | 12/2009 | Lai | |

* cited by examiner

HIGH ISOLATION ANTENNA SYSTEM

RELATED APPLICATION(S)

This application is a Continuation of and claims priority to U.S. patent application Ser. No. 12/873,823, which claims priority from U.S. Provisional Patent Application Ser. No. 61/238,931. The contents of each of the foregoing is/are hereby incorporated by reference into this application as if set forth herein in full.

BACKGROUND

The present invention relates generally to antenna systems in portable communications devices.

Many portable communications devices, including cellular handsets, personal digital assistants, smart phones, laptops, notebooks, netbooks, and tablet computers, include two or more radio communications devices operating independently and simultaneously in the same frequency band or adjacent frequency bands. For example, many devices use both Bluetooth and 802.11 radios for wireless networking. Bluetooth and 802.11n operate in the same frequency band at 2.4 to 2.5 GHz, and can interfere with each other and reduce the performance of either or both communication streams. To improve performance, high isolation is needed between the antenna ports used for the two radios.

BRIEF SUMMARY OF EMBODIMENTS OF THE INVENTION

An antenna system in accordance with one or more embodiments supports a common resonance mode and differential resonance mode, each with approximately equal radiation resistance and bandwidth at a given operating frequency band. The antenna system includes a resonant antenna section, a counterpoise, and two antenna ports. The resonant antenna section includes two spaced-apart poles and a distributed network therebetween. Each of the poles has a proximal end connected to the distributed network and an opposite distal end. The distal ends of the poles are separated from each other by a distance of ⅓ to ⅔ of the electrical wavelength at the given operating frequency. Each of the two antenna ports is defined by a pair of feed terminals with one feed terminal located on the counterpoise and the other feed terminal located on a different one of the poles of the resonant antenna section. The resonant antenna section, counterpoise, and ports are configured such that a signal within the given operating frequency band applied to one port is isolated from the other port.

An antenna system in accordance with one or more further embodiments provides isolated antenna connections to two radio communications devices operating independently and simultaneously in the same frequency band or adjacent frequency bands. The antenna system comprises a resonant antenna section, a counterpoise, and two antenna ports. The resonant antenna section comprises two spaced-apart poles and a distributed network therebetween. Each of the poles has a proximal end connected to the distributed network and an opposite distal end. The distal ends of the poles are separated from each other by a distance of ⅓ to ⅔ of the electrical wavelength at a given operating frequency. Each of the two antenna ports is associated with one of the radio communications devices. Each port is defined by a pair of feed terminals with one feed terminal located on the counterpoise and the other feed terminal located on a different one of the poles of the resonant antenna section. The resonant antenna section, counterpoise, and ports are configured such that a signal within the given operating frequency band applied to one port is isolated from the other port.

BRIEF DESCRIPTION OF THE DRAWINGS

Like reference numerals generally represent like parts in the drawings.

DETAILED DESCRIPTION

Various embodiments are directed to antenna systems in communications devices providing isolated antenna connections to two or more radio devices operating independently and simultaneously in the same frequency band or adjacent frequency bands.

Figure 1:
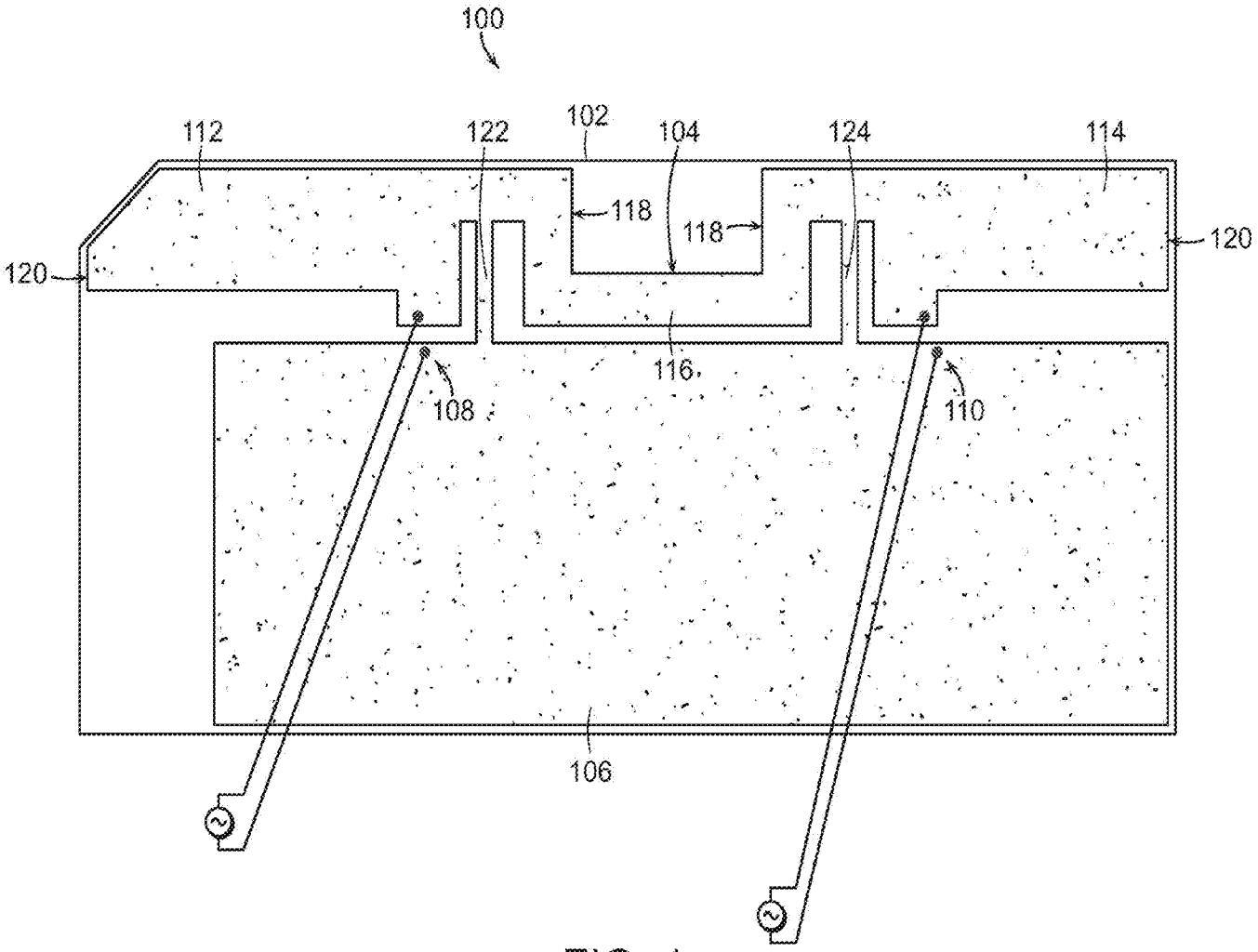
FIG. 1 illustrates an exemplary antenna system in accordance with one or more embodiments.

FIG. 1 illustrates an exemplary antenna system or assembly 100 in accordance with one or more embodiments. In this example, the antenna system 100 comprises a planar structure. In particular, it comprises a flexible printed circuit formed on a structural supporting dialectic layer 102. The antenna system 100 includes a resonant antenna section 104, a counterpoise 106, and two antenna ports 108, 110. The resonant antenna section 104, counterpoise 106, and ports 108, 110 are configured such that a signal within a given operating frequency band applied to one port is isolated from the other port.

The resonant antenna section 104 includes two spaced-apart poles 112, 114 and a distributed network 116 therebetween. The distributed network 116 comprises a connecting element that increases the isolation between the two antenna ports 108, 110.

The poles 112, 114 of the resonant antenna section 104, each include a proximal end 118 connected to the distributed network 116 and an opposite distal end 120. The distal ends 120 of the poles 112, 114 are preferably separated from each other by a distance of ⅓ to ⅔ of the electrical wavelength at the given operating frequency of the antenna. The operating frequency of the antenna system 100 is substantially determined by the electrical lengths of the two antenna poles 112, 114, each approximately ¼ of the operating wavelength in this example. The frequency response may be raised or lowered by making the poles 112, 114 electrically shorter or longer, respectively.

Each of the two antenna ports 108, 110 is defined by a pair of feed terminals. One of the feed terminals is located on the counterpoise 106, and the other feed terminal is located on one of the poles 112, 114 of the resonant antenna section 104.

The antenna system 100 can also include two inductive shorting sections 122, 124, each connecting the counterpoise 106 to a different one of the poles 112, 114 of the resonant antenna section 104. In one or more embodiments, the inductive shorting sections 122, 124 serve to match the antenna input impedance to 50 ohms at the desired operating frequency.

High isolation between the feed points is obtained at a resonant frequency dependent on the average electrical length of both antenna poles 112, 114. The impedance matching frequencies for the feed points are dependent on the relative lengths of the antenna poles 112, 114. The exemplary antenna system 100 shown in FIG. 1 is designed to be positioned in an asymmetric location (e.g., the corner of a display panel of a notebook computer) so that the natural frequency response from two feed points is different. Accordingly, the relative lengths of the antenna poles 112, 114 are different to obtain an impedance match at the same frequency, while the mean length of the antenna poles 112, 114 is set to obtain high isolation at the same frequency.

Figure 2:
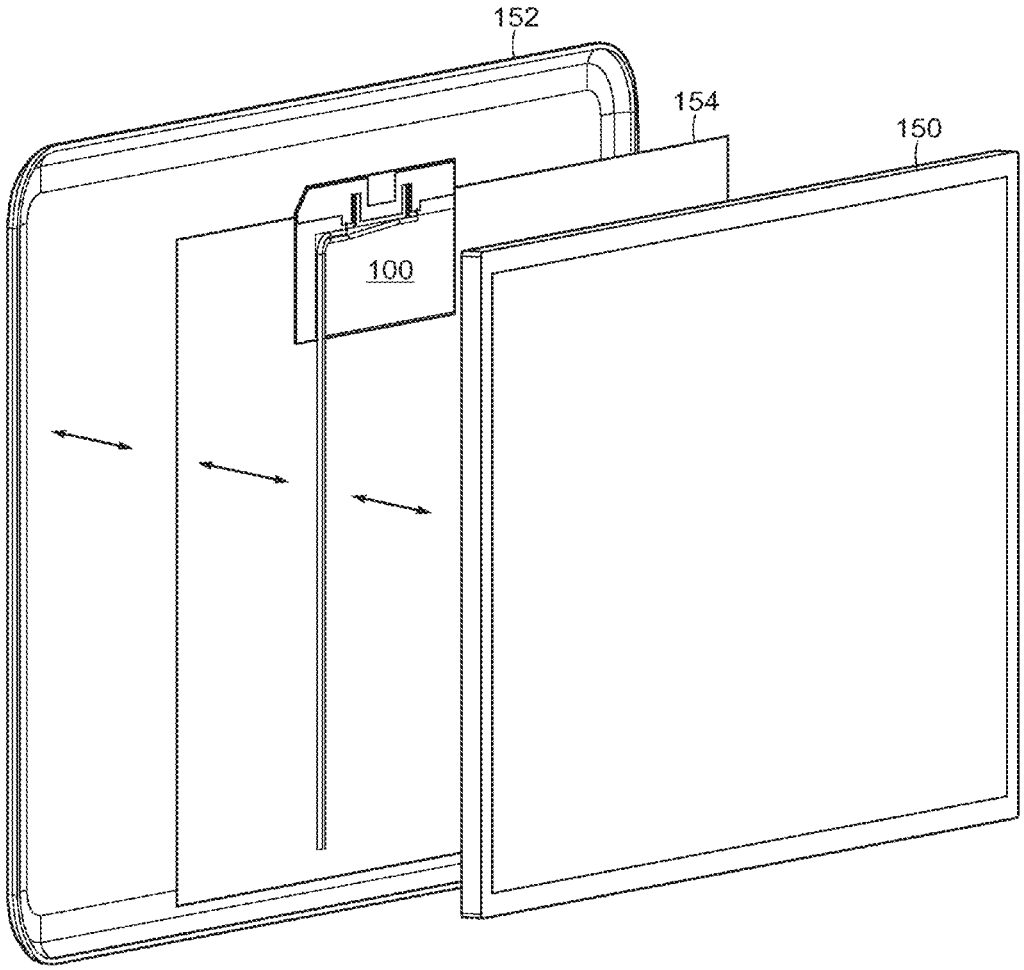
FIG. 2 illustrates integration of the exemplary antenna system into a notebook computer in accordance with one or more embodiments.

The counterpoise 106 provides for the common or ground side connection of the feed points. In one exemplary application, the counterpoise 106 is connected to a larger conductor object such as the LCD display or foil shield in a notebook computer either by direct connection or by capacitive coupling. By way of example, FIG. 2 illustrates integration of the antenna system 100 in a notebook computer by placing it behind the LCD panel 150 of the computer. In a typical notebook product, the notebook manufacturer bonds a sheet of aluminum foil 154 to the back shell 152 of the computer display section, which may serve as an EMI shield. The antenna assembly 100 may be attached to the foil shield 154 with adhesive such that the counterpoise portion 106 directly overlays the foil shield 154, while the resonant antenna section 104 extends beyond the foil shield 154 (and the LCD panel 150). Bonding the antenna assembly 100 to the foil shield 154 and back shell 152 with adhesive provides sufficient capacitive coupling between the antenna counterpoise 106 and foil shield 154 such that direct galvanic connection is not required.

Figure 3:
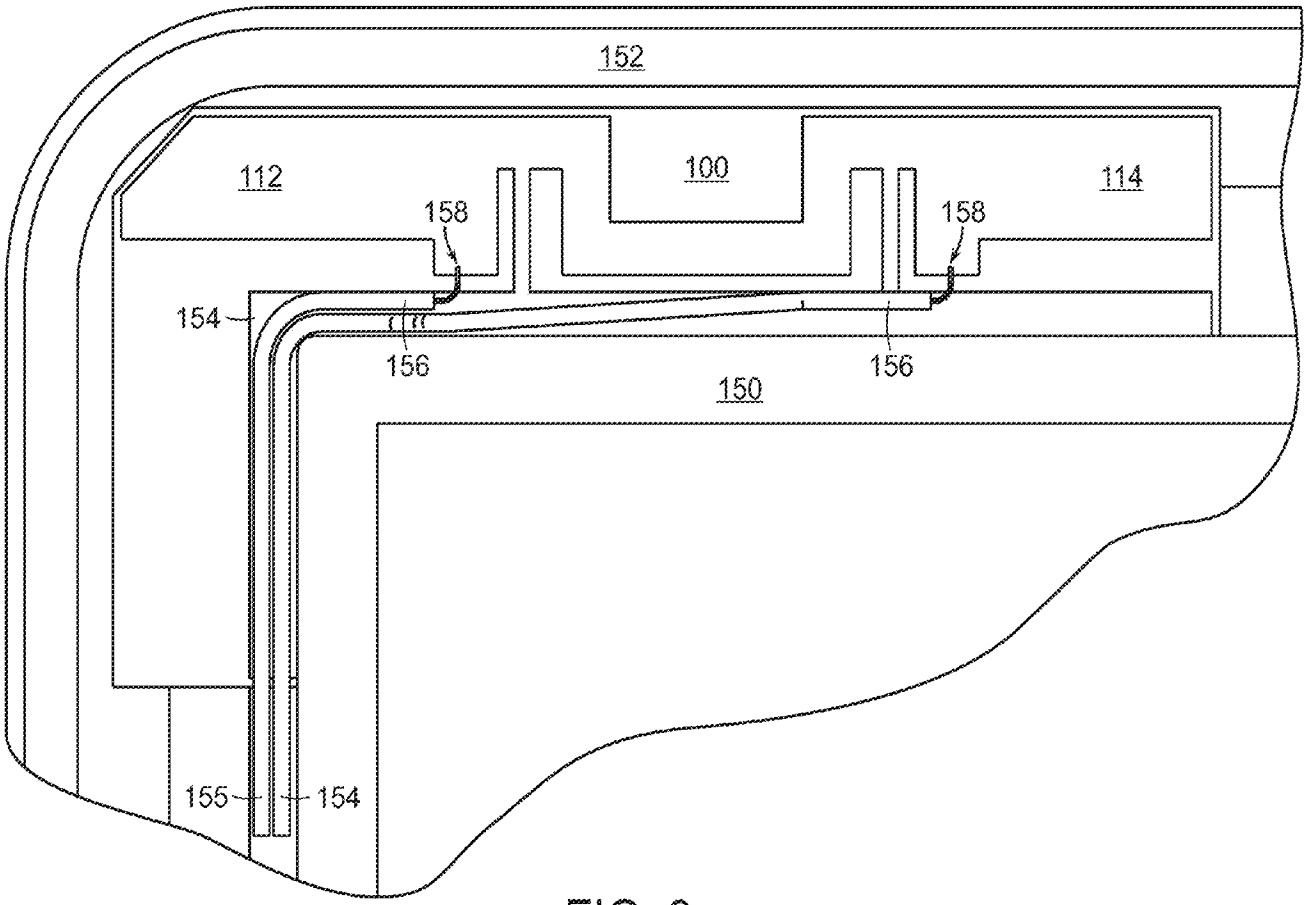
FIG. 3 illustrates in further detail the integration of the exemplary antenna system into the notebook computer in accordance with one or more embodiments.

FIG. 3 illustrates an exemplary arrangement of the antenna system 100 with respect to the LCD panel 150, foil shield 154, and back shell 152 of a notebook computer. For generally optimal isolation and bandwidth performance, the end of antenna pole portion 112 is placed at the outside corner of the back shell assembly 152. Coaxial cables 154, 155 are attached to the antenna feed by soldering the shields to the counterpoise portion 106 at 156 and the center conductors to the antenna portion at 158. The cables are routed within the area of the foil shield 154 or LCD panel 150 in the manner illustrated for maintaining high isolation.

The antenna system 100 has been found to provide high isolation between the antenna ports. In particular, isolation exceeding 30 dB has been found at a separation of the antenna poles of about 0.5 wavelength.

The antenna system 100 can provide high isolation in devices operating in various frequency bands. For example, the operating frequency band can be 2.4 to 2.5 GHz. As another example, the operating frequency band can fall within 2.3 to 2.7 GHz.

Radios associated with the ports can operate in different frequency bands. For example, the operating frequency band for one radio is 2.4 to 2.5 GHz and the operating frequency band for the other radio is within 2.3 to 2.7 GHz. In one example, one of the radios is a Bluetooth radio, and the other radio is an 802.11 radio. Alternately, one of the radios can be a WiMAX (Worldwide Interoperability for Microwave Access) radio or LTE (Long Term Evolution) radio, and the other radio is an 802.11 radio. In yet another example, one of the radios can be a WiMAX radio, and the other radio can be an LTE radio.

Figure 4:
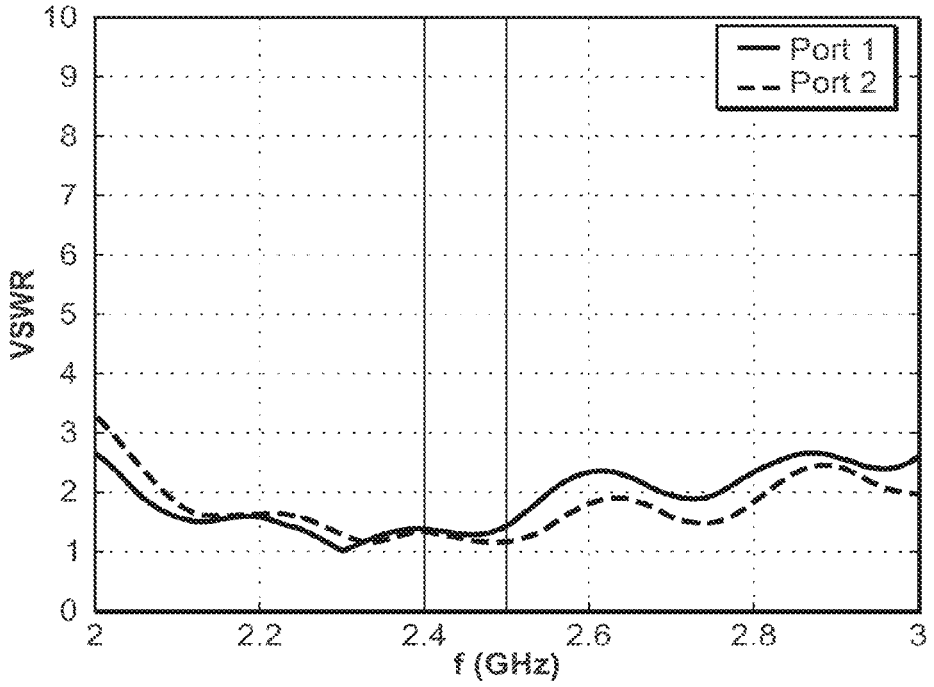
FIG. 4 is a graph illustrating VSWR measured at test ports of the antenna system of FIG. 1.
Figure 5:
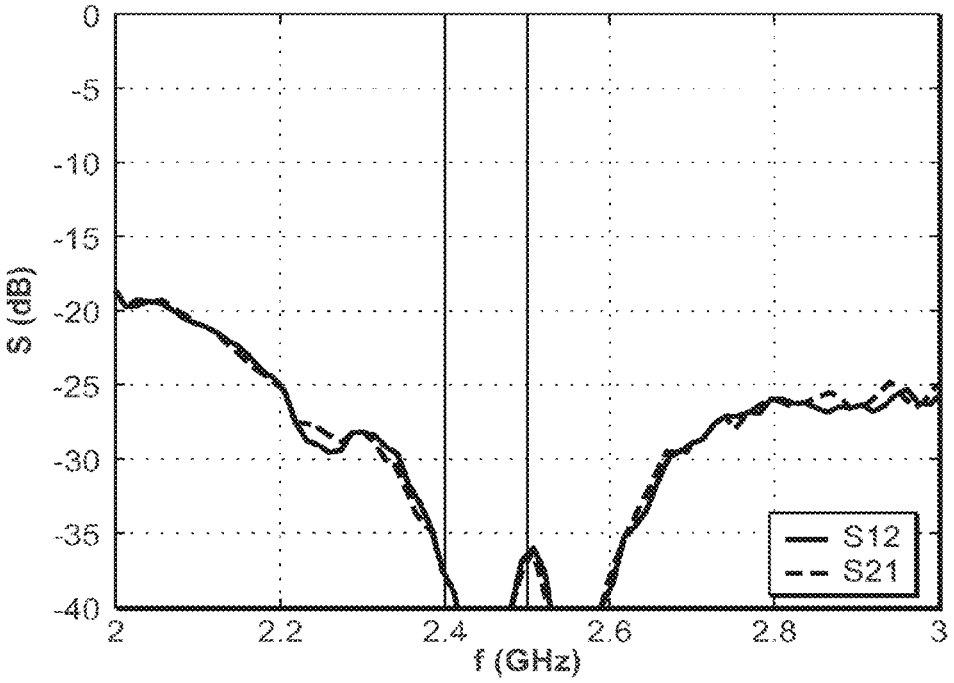
FIG. 5 is a graph illustrating coupling measured between the test ports of the antenna system of FIG. 1.
Figure 6:
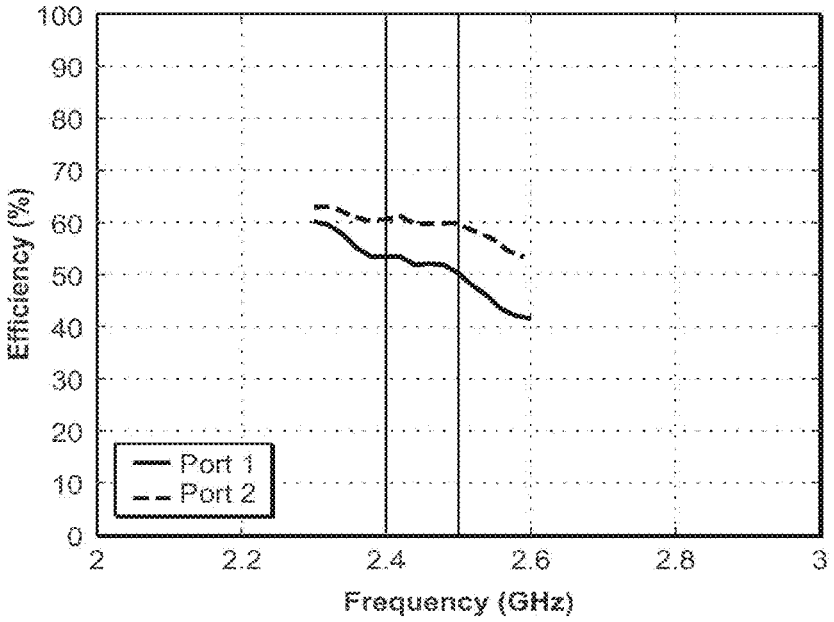
FIG. 6 is a graph illustrating measured radiation efficiency referenced from the test ports of the antenna system of FIG. 1.

FIG. 4 shows the VSWR measured at test ports of the antenna system 100 of FIG. 1. FIG. 5 shows the coupling (S21 or S12) measured between the test ports. In this example, the VSWR and coupling are advantageously low at frequencies of 2.4 to 2.5 GHz. FIG. 6 shows the measured radiation efficiency referenced from the test ports.

Figure 7:
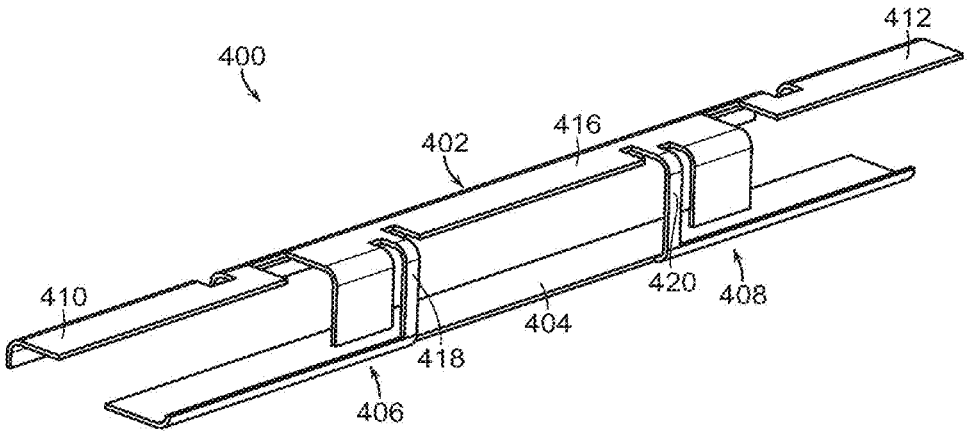
FIG. 7 illustrates an exemplary antenna system in accordance with one or more further embodiments.

In the example of FIG. 1, the antenna system 100 comprises a planar structure comprising a flexible printed circuit. It should be understood that various other structures are also possible in accordance with embodiments of the invention. For example, FIG. 7 illustrates an exemplary antenna system 400 comprising a three-dimensional structure in accordance with one or further more embodiments. The antenna system 400 can comprise a stamped metal antenna. It includes a resonant antenna section 402, a counterpoise 404, and two antenna ports 406, 408. The resonant antenna section 402 includes two spaced-apart poles 410, 412 and a distributed network 416 therebetween.

The poles 410, 412 of the resonant antenna section 402, each include a proximal end connected to the distributed network 416 and an opposite distal end. The distal ends of the poles 410, 412 are preferably separated from each other by a distance of ⅓ to ⅔ of the electrical wavelength at the given operating frequency of the antenna. The operating frequency of the antenna system 400 is substantially determined by the electrical lengths of the two antenna poles 410, 412, each approximately ¼ of the operating wavelength. The frequency response may be raised or lowered by making the poles 410, 412 electrically shorter or longer, respectively.

The antenna system 400 can also include two inductive shorting sections 418, 420, each connecting the counterpoise 404 to a different one of the poles 410, 412 of the resonant antenna section 402.

Figure 8:
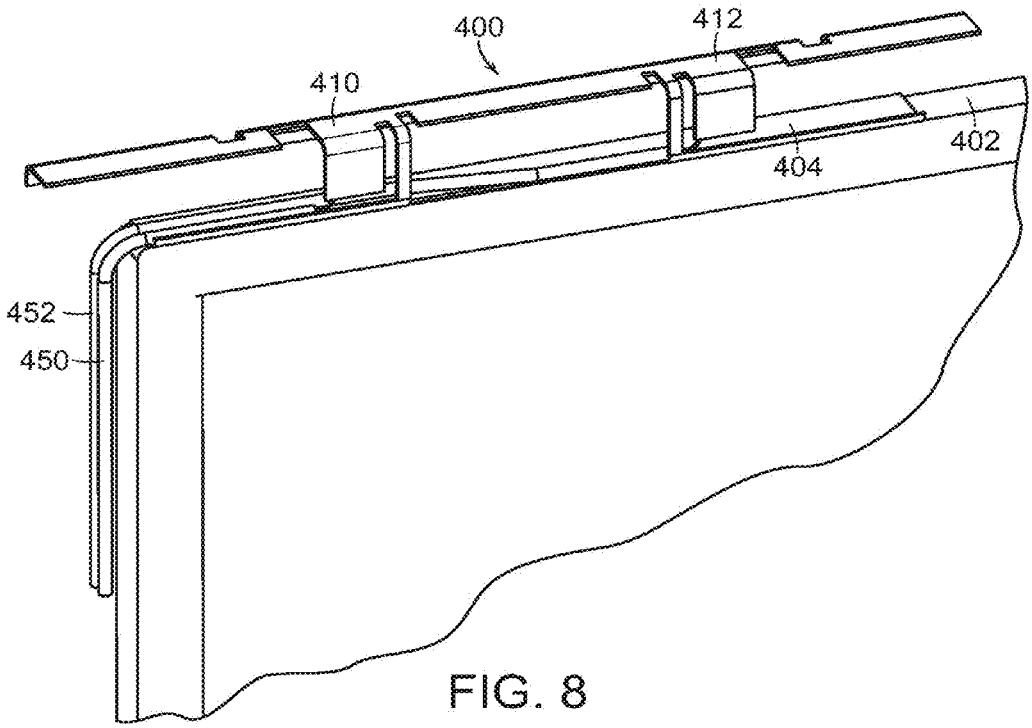
FIG. 8 illustrates integration of the exemplary antenna system of FIG. 7 into a notebook computer in accordance with one or more embodiments.

The exemplary antenna system 400 can be mounted on an LCD panel assembly as shown in the example of FIG. 8. Coaxial cables 450, 452 are attached to the antenna feed by soldering the shields to the counterpoise portion 404 and the center conductors to poles 410, 412 of the resonant antenna section 402.

Figure 9:
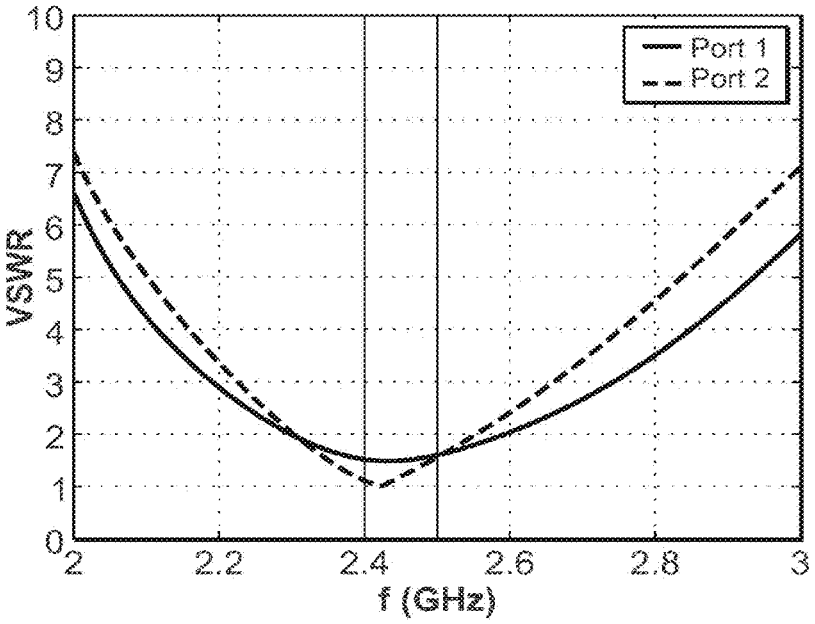
FIG. 9 is a graph illustrating VSWR measured at test ports of the antenna system of FIG. 7.
Figure 10:
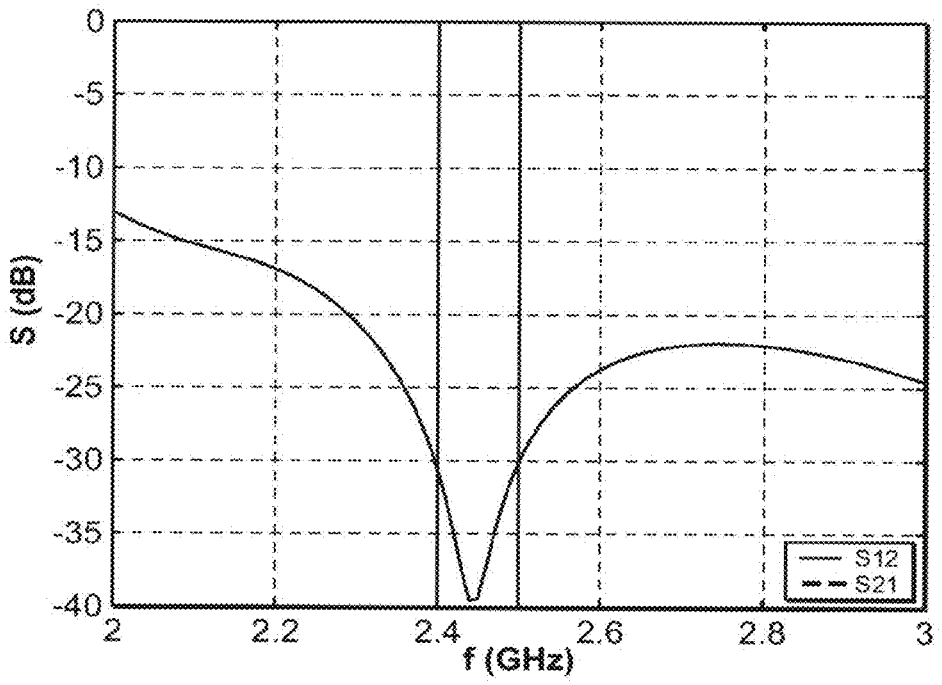
FIG. 10 is a graph illustrating coupling measured between the test ports of the antenna system of FIG. 7.
Figure 11:
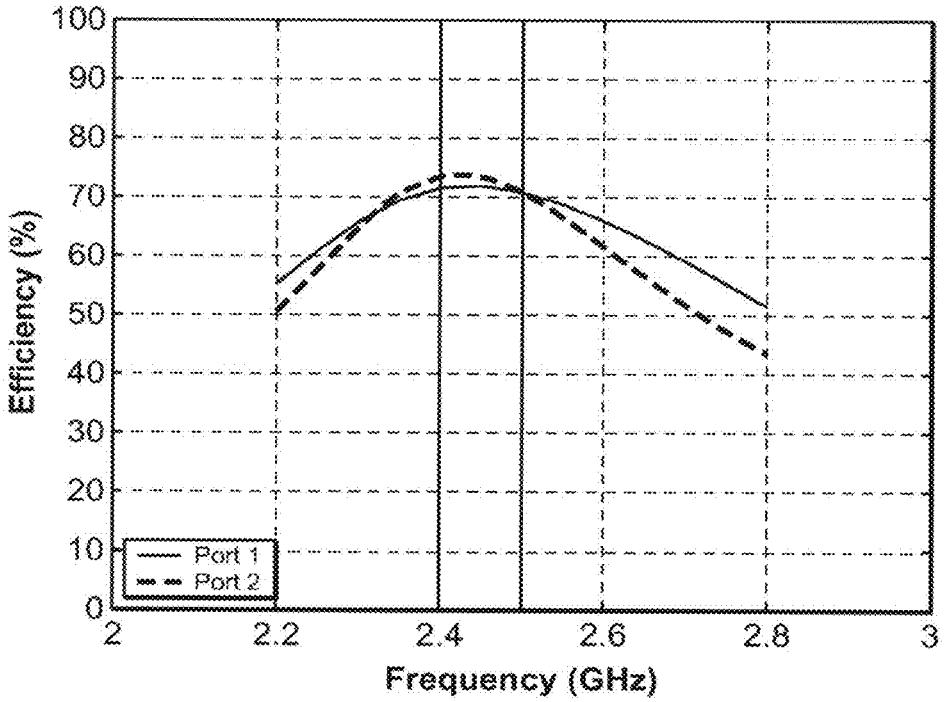
FIG. 11 is a graph illustrating measured radiation efficiency referenced from the test ports of the antenna system of FIG. 7.

FIG. 9 shows the VSWR measured at test ports of the antenna system 400 of FIG. 7. FIG. 10 shows the coupling (S21 or S12) measured between the test ports. In this example, the VSWR and coupling are advantageously low at frequencies of 2.4 to 2.5 GHz. FIG. 11 shows the measured radiation efficiency referenced from the test ports.

It is to be understood that although the invention has been described above in terms of particular embodiments, the foregoing embodiments are provided as illustrative only, and do not limit or define the scope of the invention.

Various other embodiments, including but not limited to the following, are also within the scope of the claims. For example, the elements or components of the various antenna systems described herein may be further divided into additional components or joined together to form fewer components for performing the same functions.

Having described preferred embodiments of the present invention, it should be apparent that modifications can be made without departing from the spirit and scope of the invention.

What is claimed is:

1. An antenna system supporting a common resonance mode and differential resonance mode, each with approximately equal radiation resistance and bandwidth at a given operating frequency band, the antenna system comprising:

a resonant antenna section comprising two spaced-apart poles and a distributed network there between, each of said poles having a proximal end connected to the distributed network and an opposite distal end, wherein each of the poles has a different length;

a counterpoise;

a first antenna port and a second antenna port, each port defined by a first feed terminal located on the counterpoise and a second feed terminal located on a different one of the poles of the resonant antenna section; and inductive shorting sections connected between the resonant antenna section and the counterpoise, wherein the resonant antenna section is in a first planar section that is parallel to the counterpoise in a second planar section, and wherein the inductive shorting sections are in between and perpendicular to the first and second planar sections of the resonant antenna section and the counterpoise, respectively, wherein the resonant antenna section, counterpoise, the first antenna port, and the second antenna port are configured such that a signal within the given operating frequency band applied to the first antenna port is isolated from the second antenna port, wherein the resonant antenna section is positioned at an asymmetric location with respect to the counterpoise so that a first natural frequency response from the first feed terminal differs from a second natural frequency response of the second feed terminal.

2. The antenna system of claim 1 wherein the distal ends of the poles are diametrically opposed from each other along the resonant antenna section.

3. The antenna system of claim 1, further comprising a dielectric support layer, wherein the resonant antenna section and the counterpoise are positioned on the dielectric support layer, wherein the isolation between the first antenna port and the second antenna port is at least 30 dB.

4. The antenna system of claim 1 wherein the distal ends of the poles are separated from each other by a distance of between about ⅓ to ⅔ of an electrical wavelength at the given operating frequency band.

5. The antenna system of claim 1, wherein the counterpoise is coupled with a conductor via a capacitive coupling.

6. The antenna system of claim 5, wherein the antenna system comprises a flexible printed circuit and wherein the conductor is a foil shield.

7. The antenna system of claim 1 wherein the antenna system comprises a stamped metal part.

8. The antenna system of claim 1 wherein a first radio is associated with the first antenna port and a second radio is associated with the second antenna port, and wherein the first radio operates at 2.4 to 2.5 GHz and the second radio operates at 2.3 to 2.7 GHz.

9. The antenna system of claim 1 wherein a Bluetooth radio is associated with the first antenna port and an 802.11 radio is associated with the second antenna port.

10. The antenna system of claim 1 wherein a WiMAX or LTE radio is associated with the first antenna port and an 802.11 radio is associated with the second antenna port.

11. The antenna system of claim 1 wherein a WiMAX radio is associated with the first antenna port and an LTE radio is associated with the second antenna port.

12. The antenna system of claim 1, wherein the inductive shorting sections comprise a first inductive shorting section and a second inductive shorting section that each connect the counterpoise to a corresponding different one of the poles of the resonant antenna section, wherein the inductive shorting sections provide a 50 ohm match for an antenna input impedance.

13. The antenna system of claim 1 wherein the resonant antenna section extends from the counterpoise a distance of no more than ⅛ of an electrical wavelength at the operating frequency band.

14. A computer device, comprising:

a display; and an antenna system providing isolated antenna connections to two radio communications devices operating independently and simultaneously in a same frequency band or in adjacent frequency bands, the antenna system comprising:

a resonant antenna section comprising two spaced-apart poles and a distributed network there between, each of said poles having a proximal end connected to the distributed network and an opposite distal end, wherein the each of the poles is a different length;

a counterpoise coupled to the display;

a first antenna port and a second antenna port, each port associated with one of the radio communications devices, each port being defined by a pair of feed terminals with a first feed terminal located on the counterpoise and a second feed terminal located on a different one of the poles of the resonant antenna section; and inductive shorting sections connected between the resonant antenna section and the counterpoise, wherein the resonant antenna section is in a first planar section that is parallel to the counterpoise in a second planar section, wherein the inductive shorting sections are in between and perpendicular to the first and second planar sections of the resonant antenna section and the counterpoise, respectively, wherein the resonant antenna section, counterpoise, the first antenna port, and the second antenna port are configured such that a signal within an operating frequency band that is applied to the first antenna port is isolated from the second antenna port wherein the resonant antenna section is positioned at an asymmetric location with respect to the counterpoise so that a first natural frequency response from the first feed terminal differs from a second natural frequency response of the second feed terminal.

15. The computer device of claim 14, wherein the distal ends of the poles are diametrically opposed from each other along the resonant antenna section.

16. The computer device of claim 14, wherein the counterpoise is connected with a foil shield, wherein the counterpoise overlays the foil shield and wherein the antenna section extends beyond the foil shield.

17. An antenna system, comprising:

a resonant antenna section comprising a first pole and a second pole and a distributed network therebetween, wherein each of the first pole and the second pole are of different lengths;

a counterpoise;

a first antenna port having a first pair of feed terminals;

a second antenna port having a second pair of feed terminals; and inductive shorting sections connected between the resonant antenna section and the counterpoise, wherein the resonant antenna section is in a first planar section that is parallel to the counterpoise in a second planar section, wherein a first terminal of the first pair of feed terminals is coupled with the counterpoise and a second terminal of the first pair of feed terminals is coupled with the first pole, wherein a third terminal of the second pair of feed terminals is coupled with the counterpoise and a fourth of the second pair of feed terminals is coupled with the second pole, and wherein the resonant antenna section, the counterpoise, the first antenna port, and the second antenna port are configured to provide isolation between the first antenna port and the second antenna port for a signal within an operating frequency band wherein the resonant antenna section is positioned at an asymmetric location with respect to the counterpoise so that a first natural frequency response from the first feed terminal differs from a second natural frequency response of the second feed terminal.

* * * * *